US007040500B2

(12) United States Patent
Kipperman et al.

(10) Patent No.: US 7,040,500 B2
(45) Date of Patent: May 9, 2006

(54) CONTAINER AND SCOOP ARRANGEMENT

(75) Inventors: Stuart R. Kipperman, Evansville, IN (US); Hagins Fugate, Newburgh, IN (US); Joseph M. Paul, Thomaston, CT (US); George Nukuto, Neenah, WI (US); Cathy O. Smay, Newburgh, IN (US); Robin Wiggins, Newburgh, IN (US)

(73) Assignee: Bristol-Myers Squibb Company, Princeton, NJ (US)

( * ) Notice: Subject to any disclaimer, the term of this patent is extended or adjusted under 35 U.S.C. 154(b) by 0 days.

(21) Appl. No.: 11/131,627

(22) Filed: May 18, 2005

(65) Prior Publication Data

US 2006/0000840 A1 Jan. 5, 2006

Related U.S. Application Data

(63) Continuation of application No. 10/303,449, filed on Nov. 25, 2002, now abandoned.

(51) Int. Cl.
*A47G 19/02* (2006.01)
*B65D 25/00* (2006.01)
*B65D 51/28* (2006.01)

(52) U.S. Cl. ..... 220/574.1; 220/212; 220/735; 206/553

(58) Field of Classification Search ..... 206/553, 206/572; 73/426; 215/DIG. 5; 220/574, 220/574.1, 697, 735; 229/401
See application file for complete search history.

(56) References Cited

U.S. PATENT DOCUMENTS

| | | | | |
|---|---|---|---|---|
| 1,514,379 | A | 11/1924 | Fleischer | |
| 1,607,865 | A | 11/1926 | Butler | |
| 1,703,185 | A | 2/1929 | White | |
| 1,768,771 | A | 7/1930 | La Tourrette | |
| 1,853,852 | A | 4/1932 | Estes | |
| 2,660,529 | A | 11/1953 | Bloom | |
| 2,738,900 | A | 3/1956 | Wenger | |
| 2,921,707 | A | 1/1960 | Sloan | |
| 2,978,142 | A | 4/1961 | Novick | |
| 3,001,404 | A | 9/1961 | McDonnell, Jr. et al. | |
| 3,401,825 | A | 9/1968 | Weiss | 220/60 |
| 3,448,888 | A | 6/1969 | Smith et al. | |
| 3,679,093 | A | 7/1972 | Chang | |
| 3,704,779 | A | 12/1972 | Nigg | 220/556 |
| 3,722,779 | A | 3/1973 | Chang | |
| 3,874,554 | A | 4/1975 | Chang | |
| 3,955,742 | A | 5/1976 | Marshall et al. | |
| 4,036,398 | A | 7/1977 | Hoogvelt et al. | |
| 4,095,716 | A | 6/1978 | Meany | |
| D261,234 | S | 10/1981 | Abraham | |
| 4,300,700 | A | 11/1981 | Chang | |
| 4,432,466 | A | 2/1984 | Allen | |
| 4,685,582 | A | 8/1987 | Pulciani et al. | |

(Continued)

FOREIGN PATENT DOCUMENTS

| | | | |
|---|---|---|---|
| DE | 19701101 | A1 | 7/1998 |

(Continued)

*Primary Examiner*—Bryon P. Gehman
(74) *Attorney, Agent, or Firm*—Nelson Mullins Riley & Scarborough

(57) ABSTRACT

A container for housing granulated products is disclosed. The container has a box portion having a recessed base, a front wall, a back wall, and opposing side walls, a closure adapted to be releasably sealed on the box portion, and a circumferential channel in the box base. The channel is adapted to receive a scoop bucket so that the contents of the container can be easily removed.

27 Claims, 4 Drawing Sheets

U.S. PATENT DOCUMENTS

| | | | | |
|---|---|---|---|---|
| 4,844,263 | A | 7/1989 | Hadtke | |
| D308,941 | S | 7/1990 | Kong | |
| 5,009,310 | A | 4/1991 | Finney | |
| 5,042,712 | A | 8/1991 | DeRoseau | |
| 5,054,642 | A | 10/1991 | Yoshida | |
| 5,090,572 | A | 2/1992 | DeRoseau | |
| 5,312,011 | A | 5/1994 | Fischer | |
| 5,347,865 | A | 9/1994 | Mulry et al. | |
| 5,392,945 | A | 2/1995 | Syrek | |
| 5,409,126 | A | 4/1995 | DeMars | |
| 5,409,128 | A | 4/1995 | Mitchell | |
| 5,415,309 | A | 5/1995 | Wang | |
| 5,507,389 | A | 4/1996 | Syrek | |
| D371,962 | S | 7/1996 | Petruzzi | |
| 5,647,413 | A | 7/1997 | Horrell | |
| 5,695,084 | A | 12/1997 | Chmela et al. | |
| 5,699,925 | A | 12/1997 | Petruzzi | |
| 5,705,212 | A | 1/1998 | Atkinson | |
| 5,706,974 | A | 1/1998 | Murdick et al. | |
| 5,740,914 | A | 4/1998 | Herzog | 206/501 |
| 5,775,531 | A | 7/1998 | Lowry | 220/212.5 |
| 5,799,792 | A | 9/1998 | Abrums | 206/508 |
| D416,438 | S | 11/1999 | Molo | |
| 6,021,903 | A | 2/2000 | Hanson | 206/541 |
| D459,124 | S | 6/2002 | Le et al. | |

FOREIGN PATENT DOCUMENTS

| | | | |
|---|---|---|---|
| EP | 0330024 | | 2/1989 |
| JP | 08183556 | A | 11/1996 |

CONTAINER AND SCOOP ARRANGEMENT

CROSS-REFERENCE TO RELATED PATENTS AND PATENT APPLICATIONS

This application is a continuation application and claims the priority benefit of U.S. patent application Ser. No. 10/303,449, filed Nov. 25, 2002 now abandoned, which is incorporated by reference herein in its entirety.

BACKGROUND OF THE INVENTION

1. Field of the Invention

The present invention relates to the field of container constructions in general, and more particularly to a combination container and scoop.

2. Description of the Related Art

As can be seen by reference to U.S. Pat. Nos. 1,514,379, 1,768,771 2,738,900, 2,978,142, 4,844,263, 5,699,925, 5,706,974, and D416,438, the prior art is replete with various container constructions, including those that facilitate stacking or that house utensils, such as scoops.

While various prior art constructions of containers with scoops are known, the prior art fails to disclose a container that (1) allows a user to easily scoop the entire contents of the container, (2) provides adequate structure to easily stack the containers, and (3) keeps the content scooping means from becoming buried under the container contents.

SUMMARY OF THE INVENTION

It is an object of the present invention to provide an improved container. This and other objects may be achieved by a container comprising a box portion having a recessed base, a front wall, a back wall, and opposing side walls, a closure adapted to be releasably sealed on the box portion, and a circumferential channel defined by the box portion walls and recessed base with the channel being adapted to receive a scoop so that the contents of the container can be removed. The box portion also has a heel intermediate the bottom wall and the front, rear, and side walls upon which it rests when sitting upright.

The scoop has a handle coupled to a cylindrical cup. The radius of the cylindrical cup is substantially equal to the radius of the container channel so that the cup can be received by the channel and allow scooping of the container contents.

The closure comprises front, back and side walls, a top wall coupled to the front, back, and side walls, and an upwardly extending protrusion shaped and sized to be received by the recessed base of an other like container. A plurality of flexible downwardly extending tabs located on the underside of the upward extending protrusion are adapted to releasably receive and hold the scoop. The closure further contains a recessed circumferential portion on an inner surface of the closure walls and proximate an edge of the closure walls. The recessed portion contains a plurality of inwardly projecting locking tabs located proximate the edge of the closure walls. These tabs are adapted to receive a locking flange formed on the box portion walls.

BRIEF DESCRIPTION OF THE DRAWINGS

A full and enabling disclosure of the present invention, including the best mode thereof directed to one of ordinary skill in the art, is set forth in the specification, which refers to the appended Figures, in which.

DETAILED DESCRIPTION OF THE INVENTION

Figure 1:
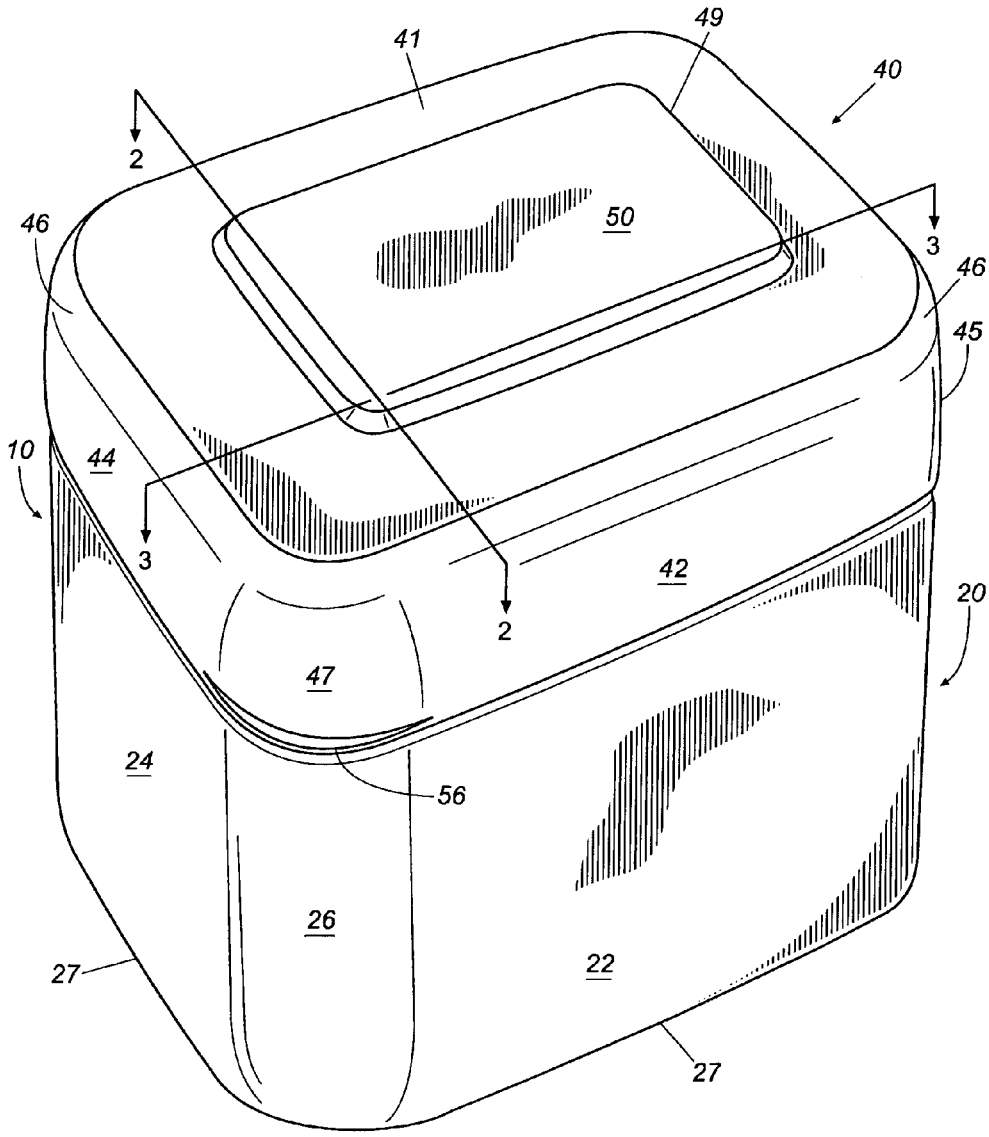
FIG. 1 is a perspective view of a container embodying the design of the present invention.

One of ordinary skill in the art will understand that the present discussion is a description of exemplary embodiments only, and is not intended as limiting the broader aspects of the present invention, which broader aspects are embodied in the exemplary construction. A repeat use of reference characters in the present specification and drawings represents the same or analogous features or elements of the invention.

With reference now to the drawings, and in particular to FIG. 1, an embodiment of the new and improved container generally designated by the reference numeral 10 will be described. The container 10 may be used for packaging granulated dry goods. The container is generally formed from two parts. The first part is a box portion 20 containing a recessed bottom wall. The second part is a closure 40 containing a tool holding mechanism and a stacking member protruding from the top wall. Box portion 20 is adapted for the removable receipt of closure 40. Box portion 20 and closure 40 may be molded of a suitable plastic material, which may be blow molded, by extrusion or injection, so that each may be a unitary member of uniform wall thickness. Non-uniform thicknesses may also be used. Suitable plastics for forming the container may include, but are not limited to, various polymers such as polystyrene, polystyrene-acrylonitile, acrylonitile-butadiene-styrene, styrene-maleicanhydride, polycarbonate, polyethylene terephthalate, polyvinylcyclohexane, and blends thereof.

Figure 2:
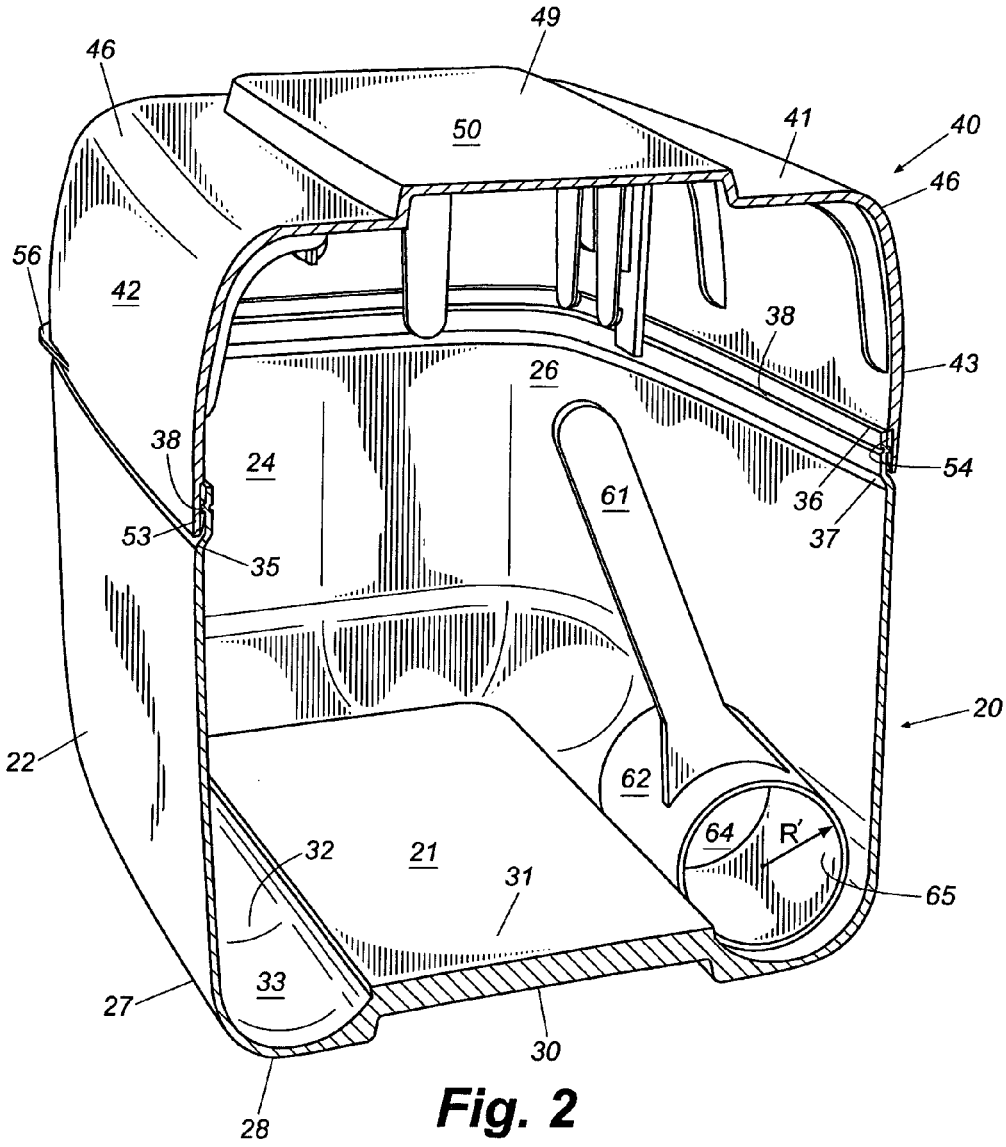
FIG. 2 is a cross-sectioned perspective view along line 2—2 of the container shown in FIG. 1, and illustrating a scoop fit in a circumferential channel in the base of the container.
Figure 3:
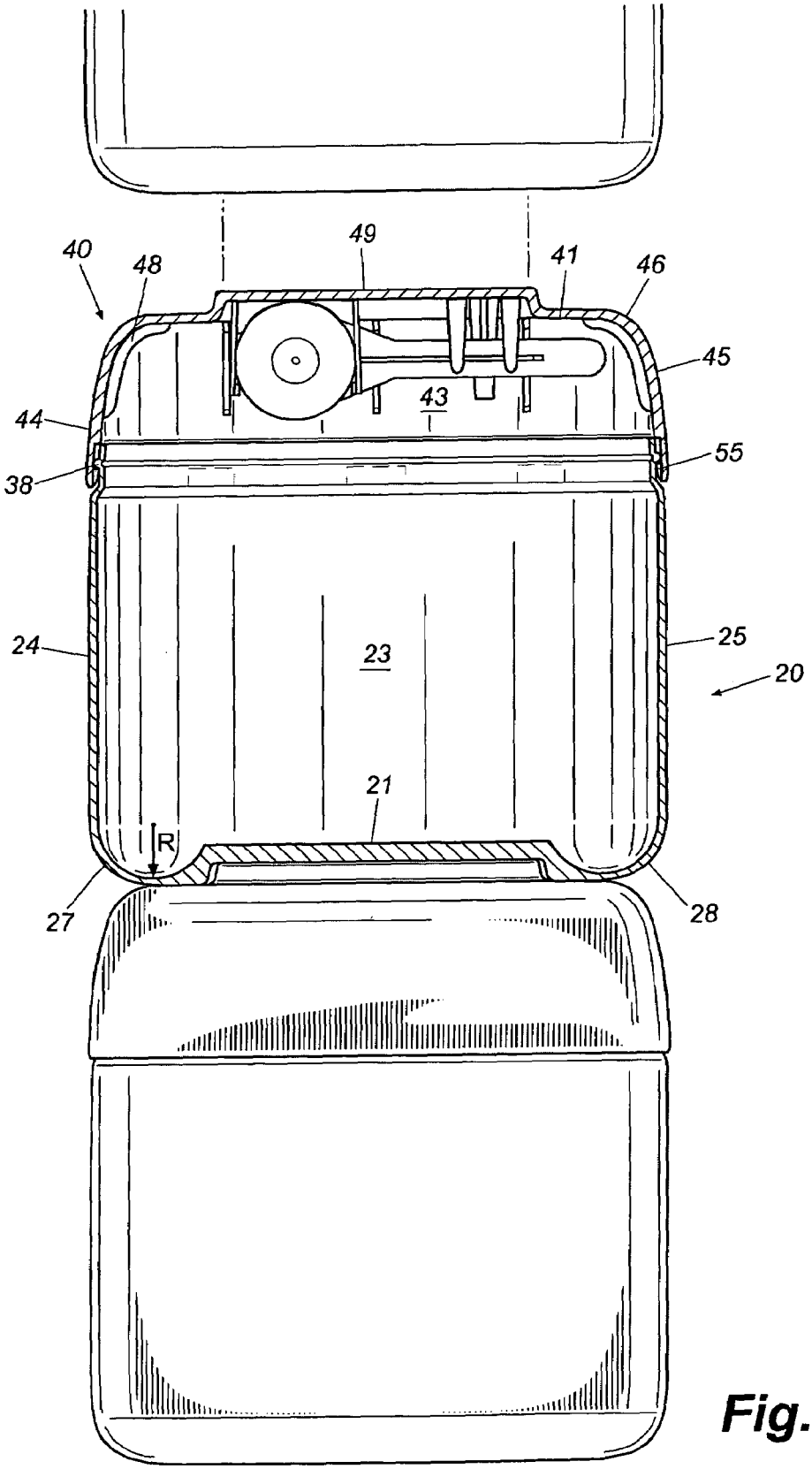
FIG. 3 is a front cross-sectional view along line 3—3 of the container shown in FIG. 1 and having its scoop mounted on the closure with the container shown in stacked fashion with multiple other containers.

As shown in FIGS. 1 and 2, box portion 20 is formed from a bottom wall 21, front wall 22, back wall 23, and opposing side walls 24 and 25 (shown in FIG. 3). The front and back walls are connected to the side walls by rounded corners 26. The front, back, and side walls are integrally formed with the bottom wall and are connected to the bottom wall by a rounded edge 27. The rounded edge extends inwardly toward recessed bottom wall 21 and forms a circumferential heel 28 on which the container rests when standing upright. The bottom wall defines a recess 30 that opens downwardly and connects to heel 28. The recess defined by the bottom wall shown as being generally rectangular in shape, but it may take on other shapes, such as square, oval, etc.

The inside surface 31 of the rectangular bottom wall projects upward from heel 28 and together with the heel, front, back, and side walls define a circumferential channel 32 around bottom wall 21. As shown in FIG. 2, channel 32 has a circular cross-section with a base 33 having a radius R (FIG. 3). Radius R is substantially equal to or less than the radius R' (FIG. 2) of a dispensing utensil 60 packaged in container 10. It should be understood that the cross-section of channel 32 may be formed in other shapes, for example square, rectangular, oval, etc.

The front, back, and side walls also contain an inwardly recessed circumferential portion 35 on their outer surface that is proximate a top edge 36. The inwardly recessed portion connects to the outer surface of the wall by an inwardly sloping shoulder 37. Shoulder 37 forms a closure stop that receives a lower lip 53 of the closure walls. The recessed portion contains an outwardly projecting circumferential flange 38 that forms part of a locking mechanism for securing the closure to the box portion.

Figure 4:
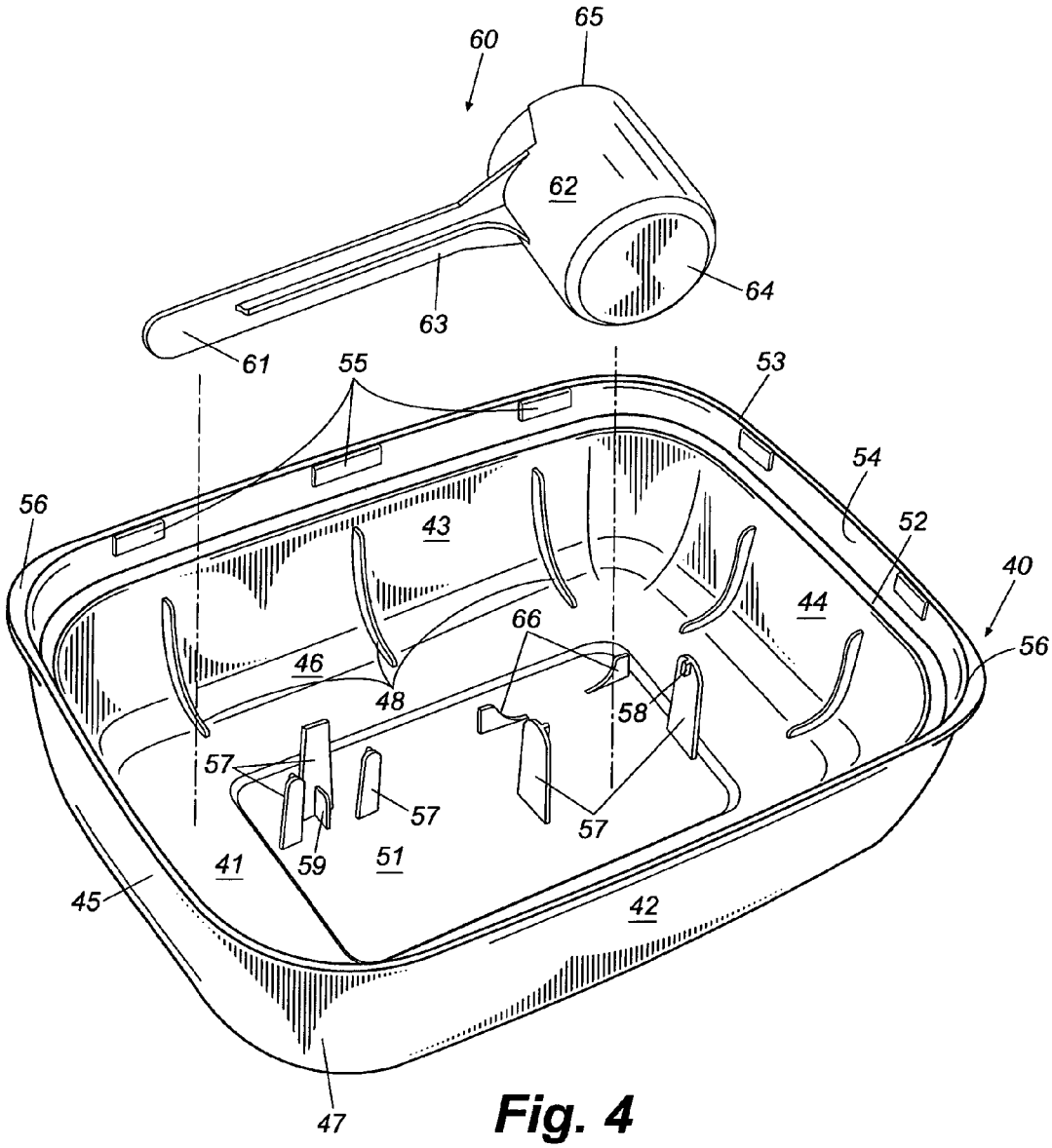
FIG. 4 is a perspective view of the container closure illustrated in FIG. 1, from underside of the closure and illustrating the scoop retaining mechanism.

Referring to the figures, and in particular FIGS. 1 and 4, the closure comprises a horizontal top wall 41 joined to a vertical front wall 42, back wall 43, and opposing side walls 44 and 45 by a rounded shoulder 46. Rounded corners 47 join the front, back, and side walls. In some embodiments, ribs 48 may be coupled to the underside of front 42, back 43, side walls 44 and 45, and horizontal top wall 41 to provide structural stability to the closure. Ribs 48 also prevent flexing of closure 40, especially when multiple filled containers are stacked one upon the other as shown in FIG. 3. A generally rectangular upwardly projecting portion 49 terminating in a horizontally flat top surface 50 is centrally located in the horizontal top wall. The horizontal flat top surface is sized and shaped to fit into another box portion's recessed bottom wall so that multiple containers can be stacked (FIG. 3). The upwardly projecting rectangular portion defines a recess 51 in the under side of closure 40. Closure 40 may also be formed without recess 51. It should be understood to one of ordinary skill in the art that upwardly projecting portion 49 may be formed in any shape so long as the mating container's recessed box portion is sized and shaped to receive the projecting portion.

An outwardly sloping shoulder 52, formed circumferentially on the inside surface of the front, back and side walls of closure 40, defines a recessed groove 54 located proximate to lower lip 53 of the walls (FIG. 4). Outward sloping shoulder 52 defines a box portion stop and receives upper lip 36 of the box portion walls. Groove 54 may or may not have both an upper and lower shoulder—groove 54 may be formed as shown in FIG. 4 without a lower shoulder thereby terminating at lip 53, or it may terminate at an inwardly sloping shoulder (not shown) forming a circumferential groove. Closure 40 is releasably secured to box portion 20 by intermittent inwardly pointing ridges 55 located on closure recess group 54 proximate lip 53. The ridges are wedge-shaped with the wide part of the wedge closest to shoulder 52. Thus, the wedge forms a locking member that snaps over the outwardly projecting circumferential flange 38 so that closure 40 can be easily removed from and resealed on box portion 20. Finger tabs 56 aid the user in removing closure 40 from box portion 20.

A releasable seal (not shown) may be attached to lip 36 to seal the contents in the container. The releasable seal also allows for vacuum packaging of the contents in container 10 and provides an anti-tamper inner liner. One skilled in the art of food packaging will be familiar with such releasably attached packaging seals. Specifically, adhesive or heat may be used to attach a seal formed of polyvinyl chloride, polystyrene, foil, or other suitable material to lip 36 to form an airtight seal. Therefore, removal of closure 40 will not disturb the seal unless the releasable seal is cut or removed.

Dispensing utensil 60 may be a scoop molded from a suitable plastic material, which may be blow molded, by extrusion or injection. Suitable plastics for forming the scoop include, but are not limited to, various polymers such as polystyrene, polystyrene-acrylonitile, acrylonitile-butadiene-styrene, styrene-maleicanhydride, polycarbonate, polyethylene terephthalate, polyvinylcyclohexane, and blends thereof. As shown in FIGS. 2 and 4, dispensing utensil 60 has a generally flat handle 61 attached to or integrally formed with a cylindrical bucket 62 having a radius R'. A rib 63 may be utilized and connected to the underside of the handle and the cylindrical bucket provides structural stability to the scoop. The cylindrical bucket is closed at one end 64 and opened at a second end 65. Bucket 62 may also be formed in many other shapes, for example square, rectangular, oval, etc.

Multiple flexible tabs 57 arranged to releasably secure dispensing utensil 60 to the underside of the closure centrally located on the bottom side 51 of the upwardly projecting rectangular portion 48. A set of three tabs 57 are arranged to secure the handle portion 61 of dispensing utensil 60 and a set of two tabs 57 are arranged to secure the bucket 62. Each tab may contain a protrusion 58 that assists in securing dispensing utensil 60 to the closure when the closure is secured to the box portion. Moreover, a rib 59 may be used to strengthen the ribs and two generally triangular ribs 66 may be used to support the bucket 62. Consequently, dispensing utensil 60 does not become buried in the granulated material and thereby eliminates the need for the user to dig through the contents in search of the scoop. This is especially important when the container's contents are for human consumption and contact with the hands is undesirable.

In addition to allowing containers to be stacked, recessed bottom wall 21 serves a second purpose. As previously pointed out, the recessed bottom wall forms circumferential channel 32 at the bottom of the box portion. The channel is sized and shaped to receive cylindrical bucket 62 of dispensing utensil 60. In particular, the radius R' of cylindrical bucket 62 is approximately equal to or smaller than the radius of curvature R of the inside surface 33 of circumferential channel 32. Recess 30 causes the granulated contents to gravitate into the channel as the product is being used up. Therefore, the bucket fits into the channel and allows the user to scoop out substantially all the granulated contents in the container with little effort (such a channel/bucket arrangement would also allow the container to be utilized for liquid containment and dispensing if desired.). No matter what shape channel 32 is, bucket 62 should be sized and shaped to be received in channel 32. For example, a square-shaped channel would require a bucket that would fit in the channel. In particular, the scoop bucket should be shaped to facilitate scooping the contents of the container out of channel 32 and is most often the same shape as the channel.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

The invention claimed is:

1. A container comprising:

a. a box portion having a recessed base, a front wall, a back wall, and side walls;

b. a closure adapted to be releasably sealed on said box portion;

c. a circumferential channel extending continuously along the entire perimeter of said recessed base, defined by said box portion walls and said recessed base; and d. a scoop having a bucket, said channel being adapted to receive the bucket of said scoop so that the bucket fits within said channel.

2. The container in claim 1, said scoop having a handle coupled to said bucket.

3. The container in claim 2, wherein the radius of said bucket is substantially equal to the radius of said channel.

4. The container in claim 3, said box portion further comprising a heel intermediate said bottom wall and said front, rear, and side walls.

5. The container in claim 1, said closure further comprising:

a. a front, a back and side walls;

b. a top wall coupled to said front, back, and side walls; and c. an upwardly extending protrusion shaped and sized to be received by the recessed base of another container.

6. The container in claim 5, said closure further comprising a plurality of downwardly extending flexible tabs located on the underside of said upwardly extending protrusion, said tabs adapted to releasably receive a scoop.

7. The container in claim 6, further comprising a scoop having a handle and a bucket that are engaged by said flexible tabs.

8. The container in claim 5, said closure further comprising:

a. a recessed circumferential portion formed on an inner surface of said closure walls proximate an edge of said closure walls; and b. a plurality of inwardly projecting locking tabs located on said inner surface recessed circumferential portion.

9. The container in claim 8, said box portion further comprising:

a. a recessed circumferential portion on an outer surface of said box portion walls proximate an edge of said box portion walls; and b. a circumferential flange located on said outer surface recessed circumferential portion, wherein said inwardly projecting locking tabs engage said flange for releasably securing said closure to said box portion.

10. A container closure, said closure comprising:

a. a front wall, a back wall, and side walls;

b. a top wall defining an upwardly projecting member, wherein said top wall is attached to said front, back and side walls;

c. a dispensing utensil comprising a handle and a bucket; and d. at least four flexible tabs that engage said utensil to secure said utensil to the underside of said top wall wherein at least two of said tabs engage said handle and at least two of said tabs engage said bucket.

11. The container closure in claim 10, wherein at least two flexible tabs engage said handle and at least two flexible tabs engage said bucket.

12. The container closure in claim 10, said closure further comprising:

a. a recessed circumferential groove on an inner surface of said closure walls proximate an edge of said closure walls; and b. an inwardly projecting flange located on said inner surface recessed circumferential groove.

13. The container closure in claim 12, wherein said inwardly projecting flange is a plurality of inwardly projecting locking tabs.

14. The container closure in claim 10, said closure further comprising a plurality of vertical ribs formed on the underside of said closure.

15. A container comprising:

a. a box portion having a recessed base defining a circumferential heel;

b. a closure adapted to be releasably sealed on said box portion, said closure comprising an upwardly extending projection;

c. a scoop comprising a handle and a bucket; and d. at least four flexible tabs protruding downwardly from the underside of said closure to releasably secure said scoop to the underside of said closure, wherein at least two flexible tabs engage said handle and at least two flexible tabs engage said bucket.

16. The container in claim 15, wherein said heel defines a circumferential channel having a size substantially equal to or smaller than the size of said bucket so that said channel is capable of receiving said bucket.

17. The container in claim in claim 16, said box portion further comprising a liner sealed to an upper lip of said box portion for creating an anti-tamper seal.

18. A container comprising:

a. a closure having an upwardly extending protrusion;

b. a box portion having a recessed base; wherein said recessed base defines a channel extending continuously along the entire perimeter of said recessed base; and c. a dispensing utensil having a bucket, said channel having a size and shape substantially equal to a dimension of said bucket of said dispensing utensil and adapted to receive said bucket of said dispensing utensil.

19. The container in claim 18, said dispensing utensil further comprising:

a. a handle; and b. a bucket.

20. The container in claim 19, wherein said bucket and said channel are shaped so that said bucket can be received in said channel.

21. The container in claim 19, wherein said bucket and said channel are cylindrically-shaped, and the radius of said channel is substantially equal to the radius of said bucket.

22. A container comprising:

a. a box portion having a recessed base, a front wall, a back wall, and side walls;

b. a closure adapted to be releasably sealed on said box portion;

c. a channel defined by said box portion walls and said recessed base, said channel extending continuously along the entire perimeter of said recessed base; and d. a scoop having a bucket, said channel being adapted to receive the bucket of said scoop so that the bucket fits within said channel.

23. The container in claim 22, said scoop having a handle coupled to a bucket.

24. The container in claim 23 wherein a cross-section of said bucket taken in a plane parallel to an opening of said bucket is substantially equal to a cross-section of said channel taken in a plane perpendicular to said base.

25. The container in claim 24, said box portion further comprising a heel intermediate said bottom wall and said front, rear, and side walls.

26. A container comprising:

a. a box portion having a recessed base, a front wall, a back wall, and side walls;

b. a closure adapted to be releasably sealed on said box portion;

c. a circumferential channel extending continuously along the entire perimeter of said recessed base defined by said box portion walls and said recessed base, said channel being adapted to receive the bucket of a scoop so that the bucket fits within said channel; and d. a scoop having a handle coupled to a bucket, wherein a radius of said bucket is substantially equal to a radius of said channel.

27. The container in claim 26, said box portion further comprising a heel intermediate said bottom wall and said front, rear, and side walls.

* * * * *

US007040500C1

(12) INTER PARTES REEXAMINATION CERTIFICATE (0162nd)

United States Patent
Kipperman et al.

(10) Number: US 7,040,500 C1
(45) Certificate Issued: May 25, 2010

(54) CONTAINER AND SCOOP ARRANGEMENT

(75) Inventors: Stuart R. Kipperman, Evansville, IN (US); Hagins Fugate, Newburgh, IN (US); Joseph M. Paul, Thomaston, CT (US); George Nukuto, Neenah, WI (US); Cathy O. Smay, Newburgh, IN (US); Robin Wiggins, Newburgh, IN (US)

(73) Assignee: Mead Johnson Nutrition Company, Evansville, IN (US)

Reexamination Request:
No. 95/001,111, Nov. 14, 2008

Reexamination Certificate for:

| | |
|---|---|
| Patent No.: | **7,040,500** |
| Issued: | **May 9, 2006** |
| Appl. No.: | **11/131,627** |
| Filed: | **May 18, 2005** |

Related U.S. Application Data

(63) Continuation of application No. 10/303,449, filed on Nov. 25, 2002, now abandoned.

(51) Int. Cl.

| | |
|---|---|
| ***A47G 19/02*** | (2006.01) |
| ***B65D 25/00*** | (2006.01) |
| ***B65D 51/28*** | (2006.01) |

(52) U.S. Cl. ..... 220/574.1; 220/212; 220/735; 206/553

(58) Field of Classification Search ..... 222/143
See application file for complete search history.

(56) References Cited

U.S. PATENT DOCUMENTS

| | | | | |
|---|---|---|---|---|
| 3,338,468 | A | | 8/1967 | Wilson |
| 3,913,785 | A | * | 10/1975 | Pattershall ..... 220/733 |
| 4,095,716 | A | | 6/1978 | Meany |
| 5,706,974 | A | | 1/1998 | Murdick et al. |
| 7,370,788 | B1 | | 5/2008 | Otani et al. |

FOREIGN PATENT DOCUMENTS

| | | |
|---|---|---|
| DE | 197 01 101 A1 | 7/1998 |
| FR | 2 747 107 A1 | 10/1997 |
| JP | 08-183556 A | 7/1996 |

* cited by examiner

*Primary Examiner*—Joseph A. Kaufman

(57) ABSTRACT

A container for housing granulated products is disclosed. The container has a box portion having a recessed base, a front wall, a back wall, and opposing side walls, a closure adapted to be releasably sealed on the box portion, and a circumferential channel in the box base. The channel is adapted to receive a scoop bucket so that the contents of the container can be easily removed.

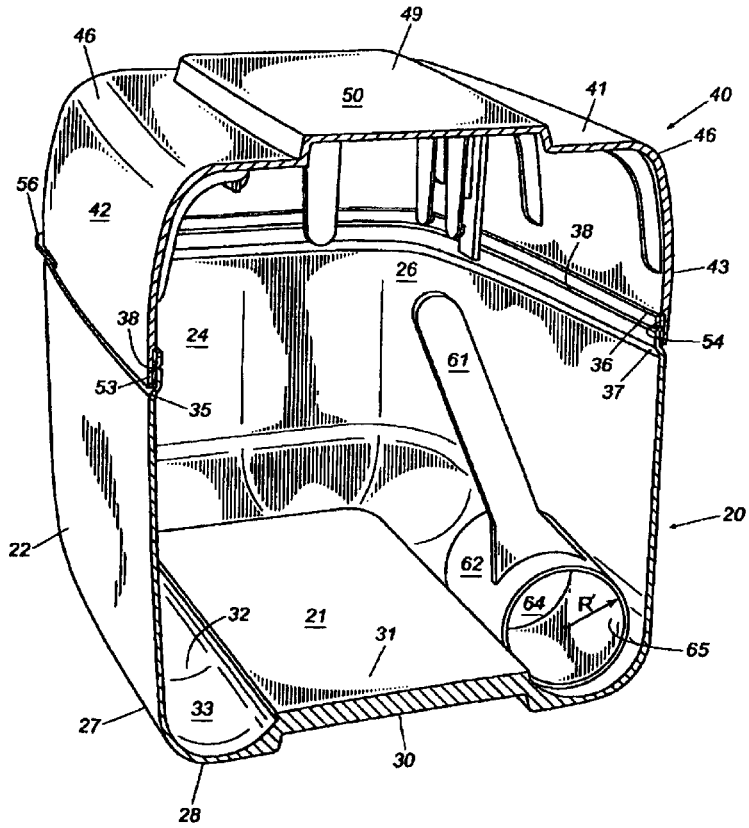

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 26 is confirmed.

Claim 16 is cancelled.

Claim 15 is determined to be patentable as amended.

Claims 1-14, 17-25 and 27 were not reexamined.

15. A container comprising:

a. a box portion having a recessed base defining a circumferential heel;

b. a closure adapted to be releasably sealed on said box portion, said closure comprising an upwardly extending projection;

c. a scoop comprising a handle and a bucket; [and]

d. at least four flexible tabs protruding downwardly from the underside of said closure to releasably secure said scoop to the underside of said closure, wherein at least two flexible tabs engage said handle and at least two flexible tabs engage said bucket[.]*; and*

*e. wherein said heel defines a circumferential channel, the bucket having a radius substantially equal to or smaller than a radius of the channel so that said channel is capable of receiving said bucket.*

* * * * *